United States Patent [19]

Webinger

[11] Patent Number: 4,477,017

[45] Date of Patent: Oct. 16, 1984

[54] LOCK BOTTOM CARTON

[75] Inventor: George P. Webinger, Robbinsdale, Minn.

[73] Assignee: Champion International Corporation, Stamford, Conn.

[21] Appl. No.: 574,947

[22] Filed: Jan. 30, 1984

Related U.S. Application Data

[63] Continuation of Ser. No. 461,023, Jan. 26, 1983, abandoned.

[51] Int. Cl.[3] ..... B65D 5/10

[52] U.S. Cl. ..... 229/39 R; 229/38

[58] Field of Search ..... 229/38, 39 R, 44 R

[56] References Cited

U.S. PATENT DOCUMENTS

| | | | |
|---|---|---|---|
| 3,140,812 | 7/1964 | Hall et al. | 229/39 R |
| 3,462,066 | 8/1969 | Farquhar | 229/39 R |
| 3,801,001 | 4/1974 | Taylor | 229/39 R |

FOREIGN PATENT DOCUMENTS

| | | | |
|---|---|---|---|
| 1118691 | 11/1961 | Fed. Rep. of Germany | 229/39 R |
| 1063100 | 12/1953 | France | 229/39 R |

*Primary Examiner*—William Price
*Assistant Examiner*—Gary E. Elkins
*Attorney, Agent, or Firm*—Evelyn M. Sommer; William W. Jones

[57] ABSTRACT

A carton having a front wall with a full width inner bottom panel extending therefrom provided with a cutout therein having end slits therein and a rear wall having an outer bottom flap extending therefrom and locking edges which are inserted into the cutout in the inner bottom panel. The side walls of the container have side bottom panels extending from each which have locking points adapted to be inserted into the cutout in the inner bottom panel. When pressure is applied to the bottom panels from the interior, the locking points in the outer bottom flap are locked into the end slits of the inner bottom panel cutout to lock the four bottom panels together.

2 Claims, 8 Drawing Figures

LOCK BOTTOM CARTON

This application is a continuation of application Ser. No. 461,023, filed Jan. 26, 1983, now abandoned.

BAKCGROUND OF THE INVENTION

The present invention relates to an improved carton and more particularly to an improved carton with an improved self-locking bottom.

Traditionally, bottom locking cartons have included a glued bottom wall assembly. However, such cartons are expensive and often require the gluing of the bottom as a separate operation. Other cartons have been developed which feature a so-called "snap-lock bottom" comprising non-adhesively interlocked bottom panels to form a self-locking bottom. It has been found that such automatic bottom-forming cartons do not give the greater bottom strength that may be desired for the weight of the contents of the cartons. In some of such cartons, special tools were required to form the bottom. In other cartons, the bottom-forming panels are not full panels so that the bottom is not as strong as may be desired.

BRIEF DESCRIPTION OF THE INVENTION

The present invention overcomes the above drawbacks and has for one of its objects the provision of an improved carton having improved non-adhesive bottom-forming panels.

Another object of the present invention is the provision of an improved carton in which the bottom may be easily formed without the use of special tools.

Another object of the present invention is the provision of an improved carton in which the bottom comprises a full width bottom panel which gives extra strength to the bottom.

Another object of the present invention is the provision of an improved interlocking bottom assembly which will prevent the bottom panels from slipping away from each other when weight is applied to the bottom from the interior of the carton.

Other and further objects of the invention will be obvious upon an understanding of the illustrative embodiment about to be described, or will be indicated in the appended claims, and various advantages not referred to herein will occur to one skilled in the art upon employment of the invention in practice.

Briefly, the present invention comprises a carton having a front wall with a full width inner bottom panel extending therefrom provided with a slot or cutout therein having end slits therein. Each slide wall of the carton is provided with an intermediate bottom panel which has locking points adapted to be inserted into the slot or cutout in the inner bottom panel. The rear wall of the carton has an outer bottom panel extending therefrom and locking edges which are also inserted into the bottom cutout. When pressure is applied to the bottom from the interior, the points in the outer bottom panel are locked into the end slits of the inner bottom wall panel cutout or slot to effectively lock the four bottom panels together.

BRIEF DESCRIPTION OF THE DRAWINGS

A preferred embodiment of the invention has been chosen for purposes of illustration and description and is shown in the accompanying drawings forming a part of the specification, wherein.

DETAILED DESCRIPTION OF THE INVENTION

Figure 1:
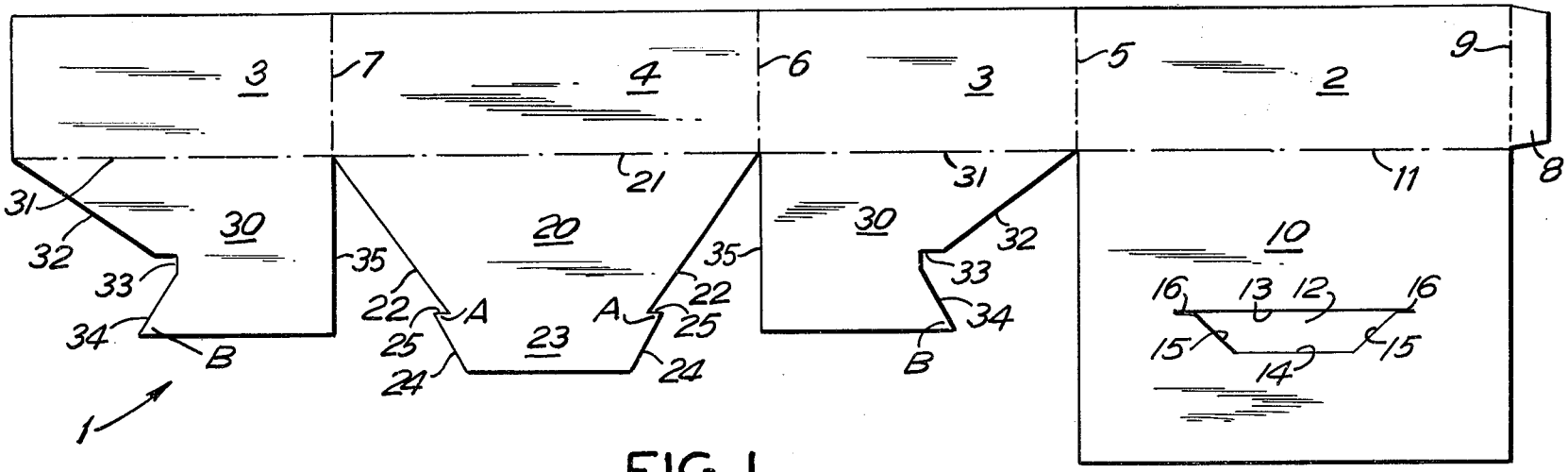
FIG. 1 is a plan view of the blank used in connection with the present invention.

Referring to the drawings and more particularly to FIG. 1, the blank 1 of the present invention may be made from a single piece of diecut and scored paperboard material and comprises a front wall panel 2 and rear wall panel 4 and a pair of side wall panels 3. The front, rear and side wall panels 2 to 4 are foldable relative to each other along fold lines 5, 6 and 7 and a glue end flap 8 extends from front wall 2 and is foldable relative thereto along a fold line 9. It will be understood that the terms "front", "rear" and "side" used herein are used merely for convenience of description since it is within the purview of the present invention for any of the panels described herein to form the front, rear or sides of the finished carton.

The front wall panel 2 is provided with an inner bottom wall panel 10 extending therefrom and foldable relative thereto along a fold line 11. The inner bottom wall panel 10 is provided with a slot or a cutout 12 which is shown in the drawings as being preferably trapezoidal in shape. The cutout or slot 12 has a pair of opposed parallel edges 13 and 14 and a pair of tapered side edges 15. A pair of edge slits 16 extending outwardly from the ends of the longer edge 13 are provided in the inner bottom wall panel 10. It will be noted that the inner bottom panel 10 is preferably large enough to extend across and bridge the entire space between front, rear and side wall panels 2 to 4 when it is folded down (FIG. 4) so that it forms a full bottom panel. However, it will be understood that it is within the purview of this invention for the inner bottom panel 10 to be less than a full bottom panel, if desired.

The rear wall panel 4 has an outer bottom wall panel 20 extending therefrom and foldable relative thereto along a fold line 21. Preferably, the outer bottom wall panel 20 is generally trapezoidal in shape having inwardly tapered side edges 22 and a locking tab 23 at its outer edge. The locking tab 23 which is also preferably trapezoidal in shape has tapered end edges 24 which extend outwardly from and are parallel to the side edges 22 of the outer bottom wall panel 20 to form notches 25 and locking points A. It will be noted that the distance of the locking tab 23 from the fold line 21 in the outer bottom wall panel 20 is substantially the same as the distance of the cutout or slot 12 in the inner bottom wall panel 10 from the fold line 11 so that the locking tab 23 can be inserted into the cutout or slot 12 in the inner bottom wall panel 10 and the locking points A hooked under the longer edge 13 of the cutout 12 when the outer bottom wall panel 20 is folded.

Each side wall panel 3 has intermediate bottom wall panel 30 extending therefrom and foldable relative thereto along a fold line 31. Each intermediate bottom wall panel 30 is provided with a straight end edge 35 coextensive with fold lines 6-7 and an inwardly tapered end edge 32 terminating in a notch 33 communicating with an outwardly tapered end edge 34 in lock points B. The distance between the locking points B from the fold line 31 in each intermediate bottom panel 30 is approximately the same as the distance between the cutout or slot 12 in the inner bottom wall panel 10 to its fold line 11 so that the locking points B can be inserted into the cutout or slot 12 with the locking points B hooked under longer edge 13 in cutout 12 when the intermediate bottom wall panels 30 are folded down.

Figure 2:
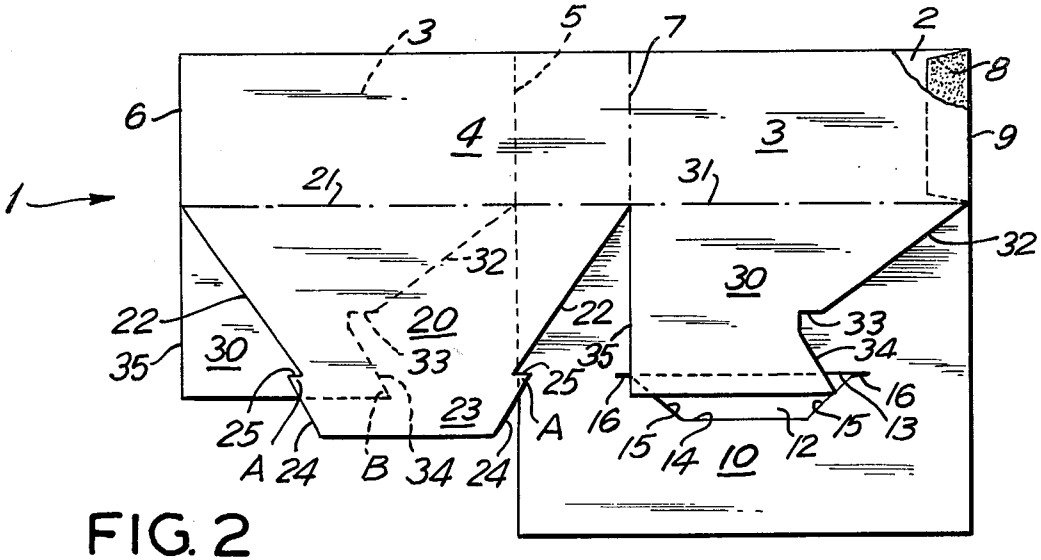
FIG. 2 is a plan view showing the carton formed from the blank of FIG. 1 in a flattened position.
Figure 3:
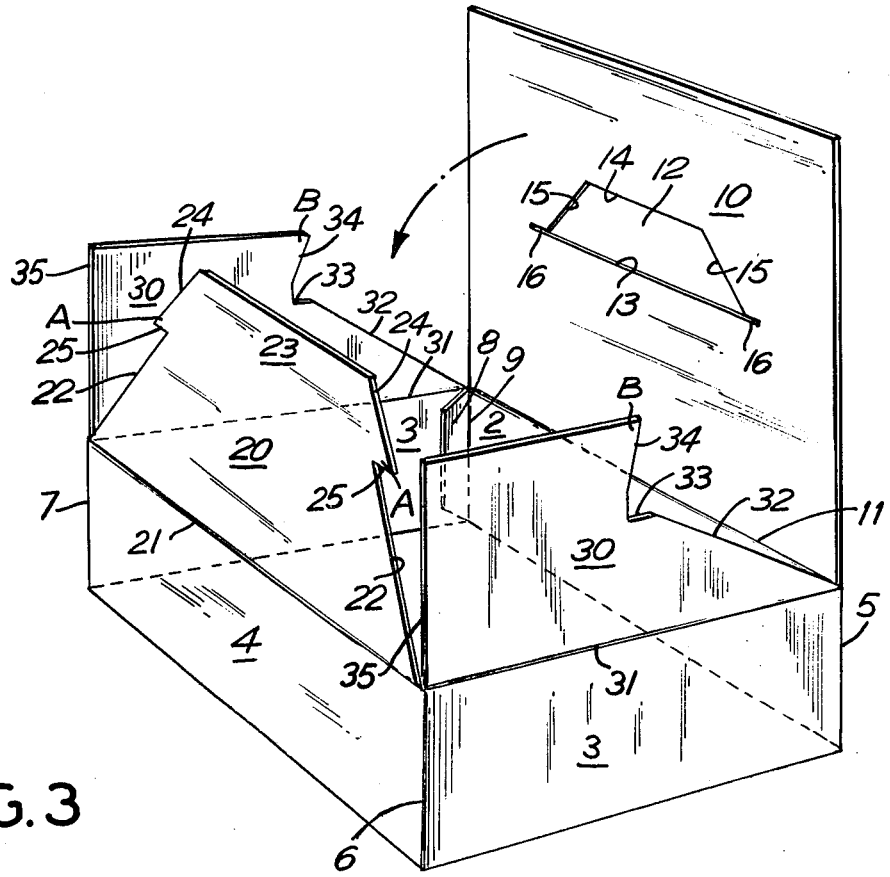
FIG. 3 is a perspective view showing the first step in assembling the carton.
Figure 4:
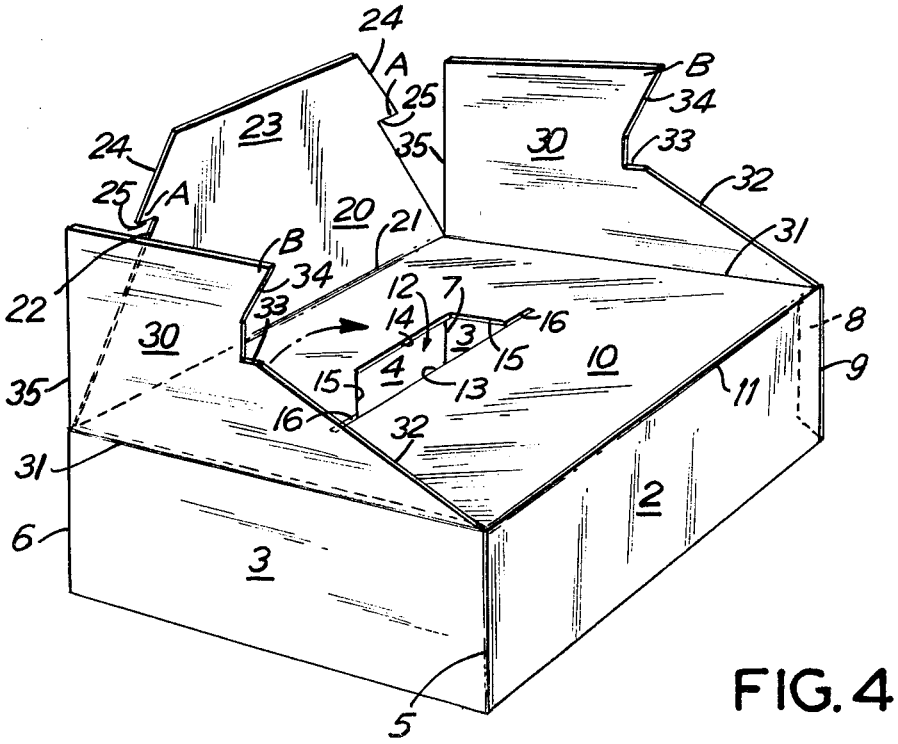
FIG. 4 is a perspective view showing a subsequent step in the carton assembly.

In assembling the carton 1, the side wall panels 3 and the front and rear wall panels 2 and 4 of the blank are first folded along the fold lines 5 to 7 to form front, side and rear walls 2, 3 and 4, respectively, and the glue tab 8 is adhered to the inner edge of the outer side wall 3 as shown in FIG. 2. The inner bottom wall panel 10 is then folded downwardly along fold line 11, as shown in FIGS. 3 and 4, to form an inner bottom wall 10 which bridges the entire space between front, rear and side walls 2 to 4.

Figure 5:
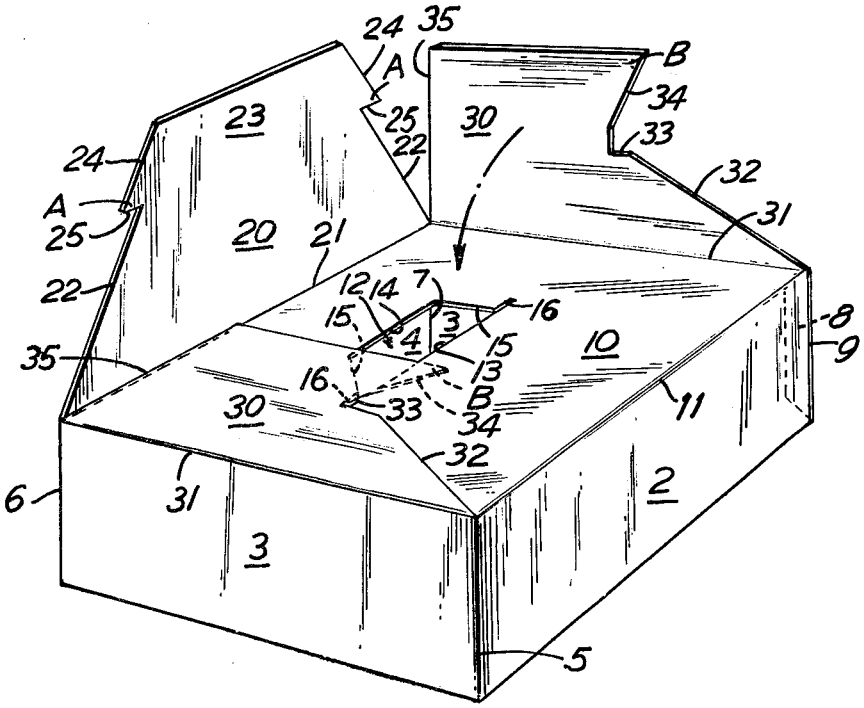
FIG. 5 is a perspective view showing the side bottom panels being folded.

As shown in FIG. 5, the intermediate bottom wall panels 30 are then folded down along fold lines 31 over the inner bottom wall 10 to form intermediate bottom walls 30. The locking points B in said intermediate bottom walls 30 are inserted into the cutout or slot 12 in the inner bottom wall 10, as shown in FIGS. 5 and 6.

Figure 6:
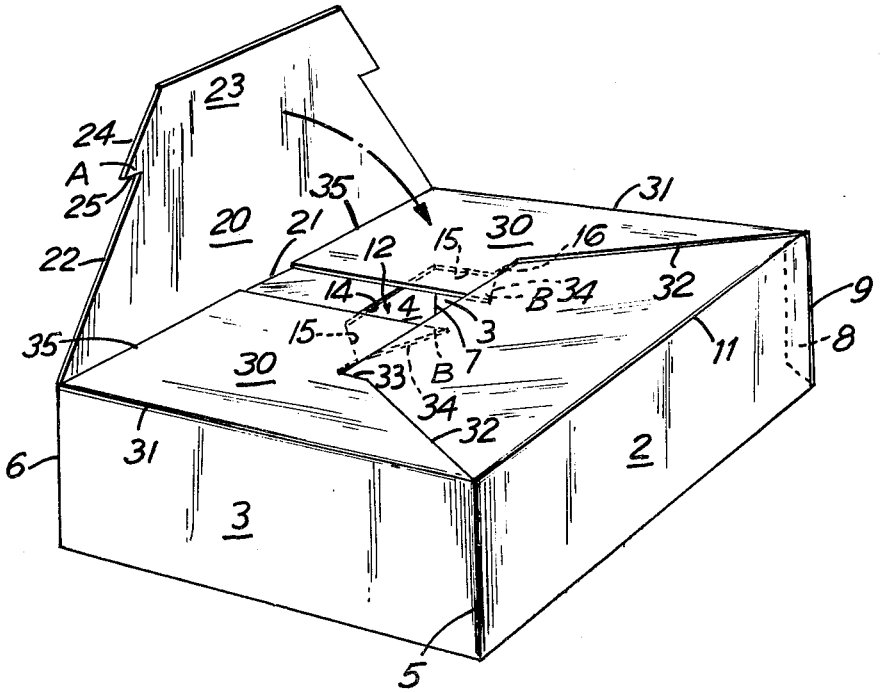
FIG. 6 is a perspective view showing the outer bottom panel being folded.
Figure 7:
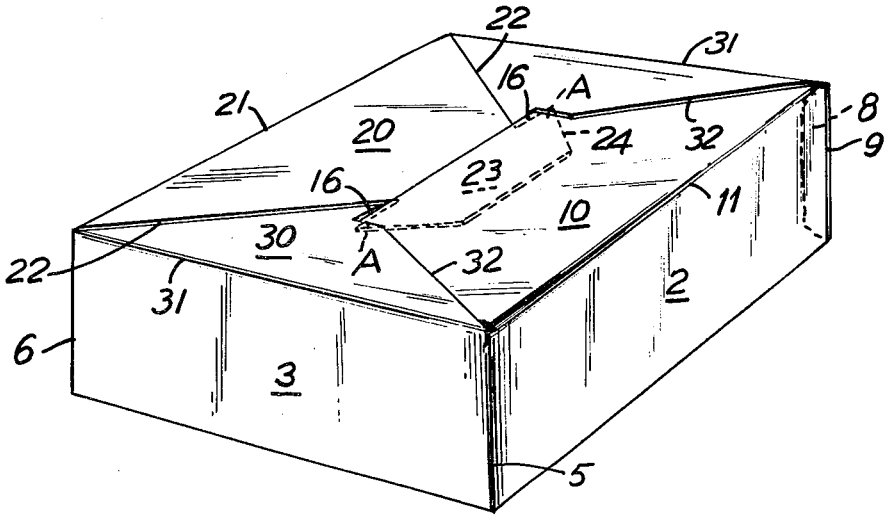
FIG. 7 is a perspective view showing the completed bottom in its interlocking position.
Figure 8:
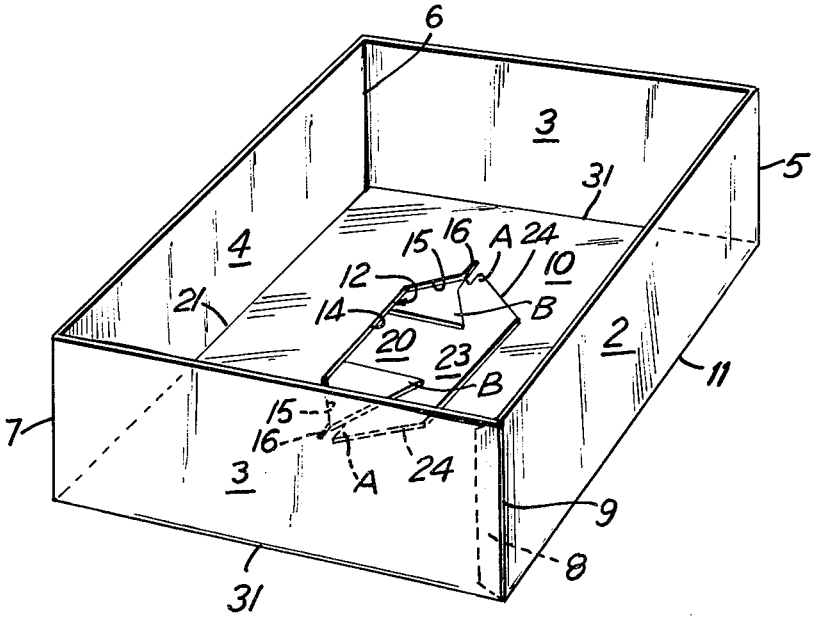
FIG. 8 is a perspective view showing the bottom wall panels from the interior of the carton.

The outer bottom wall panel 20 is then folded down along fold line 21 over the inner and intermediate bottom walls 10 and 30, as shown in FIGS. 6 and 7, to form outer bottom wall 20 and the locking points A of the locking tab 23 are inserted in the cutout or slot 12. When pressure is applied to the bottom of the interior of the assembled carton 1, the locking points A on the locking tab 23 are moved within the locking slits 16 in the cutout or slot 12 in order to lock the bottom in position.

When it is desired to again flatten the carton 1 for storage or shipping, it is merely necessary to slip locking points A and B of the outer and intermediate bottom walls 20 30, respectively, and out of the cutout or slot 12 in the inner bottom wall 10 and to unfold all of the bottom walls 10, 20 and 30 so that the carton can assume the flattened position of FIG. 2.

It will thus be seen that the present invention provides an improved carton having a non-adhesive full width bottom which may be easily formed without the use of special tools and which has extra strength to prevent the bottom wall panels from slipping away from each other when weight is applied to the bottom from the interior of the carton.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. In a paperboard carton comprising front, back and side wall panels foldably connected in series, a bottom wall construction comprising:

(a) an inner bottom wall panel foldably connected to one of said front and back wall panels along a first fold line and disposed substantially perpendicular to said one of said panels, said inner bottom wall panel including a medial slot having a locking edge disposed parallel to said first fold line with opposite ends of said locking edge being defined by a pair of locking slits;

(b) a pair of intermediate bottom wall panels foldably connected to said side wall panels along second parallel fold lines, said intermediate bottom wall panels including basal portions adjacent to said second fold lines with said basal portions outwardly overlying said inner bottom wall panel, and said intermediate bottom wall panels each further including a locking point extending through said medial slot to inwardly underlie said inner bottom wall panel, each of said intermediate bottom wall panels having a notch between said basal portion and said locking point and said notch defining an edge of each of said intermediate bottom wall panels which edge is parallel to said second fold lines and outwardly adjacent to said locking slits to allow free access to the latter; and (c) an outer bottom wall panel foldably connected to the other of said front and back wall panels along a third fold line, said outer bottom wall panel overlying said inner bottom wall panel and said intermediate bottom wall panels and including a terminal locking tab extending through said slot to underlie said inner bottom wall panel, said locking tab having opposed lateral locking points which extend past said intermediate bottom wall panel notches and through said locking slits to engage the latter to lock said bottom wall construction in place.

2. A one piece paperboard carton blank comprising:

(a) front, back and side wall panels foldably connected together by a series of parallel fold lines;

(b) a first bottom wall panel connected to one of said front and back wall panels along a first fold line, said first bottom wall panel having a medial slot therein with said medial slot having an edge thereof parallel to said first fold line, with ends of said edge being formed by a pair of colinear locking slits;

(c) a second bottom wall panel connected to the other of said front and back wall panels along a second fold line, said second bottom wall panel having a free end thereof formed with a locking tab, said locking tab including a pair of lateral locking points formed thereon; and (d) third and bottom wall panels foldably connected to each of said side wall panels along third fold lines, each of said third bottom wall panels including a basal portion adjacent to said third fold lines and a distal portion formed with oppositely projecting locking points, each of said third bottom wall panels having a compound edge including an inwardly tapered basal portion, an intermediate notched portion, and an outwardly tapered distal portion, said notched portion including a first edge parallel to said third fold lines and a second edge normal to said first edge and extending to said outwardly tapered distal portion.

* * * * *